United States Patent [19]

Milliman

[11] Patent Number: 4,589,219

[45] Date of Patent: May 20, 1986

[54] ADJUSTABLE CHEEKPIECE FOR GUNSTOCK

[75] Inventor: Keith Milliman, Fairport, N.Y.

[73] Assignee: The Coleman Company, Inc., Wichita, Kans.

[21] Appl. No.: 646,313

[22] Filed: Aug. 31, 1984

[51] Int. Cl.[4] ..... F41C 23/00

[52] U.S. Cl. ..... 42/73

[58] Field of Search ..... 42/71 R, 72, 73, 74

[56] References Cited

U.S. PATENT DOCUMENTS

| | | | |
|---|---|---|---|
| 717,011 | 12/1902 | Marsland | 42/71 R |
| 2,066,218 | 12/1936 | Morgan | 42/73 |
| 2,432,519 | 5/1945 | Garand | 42/71 R |
| 2,669,051 | 5/1951 | Cline | 42/71 R |
| 3,710,496 | 1/1973 | Packmayer | 42/73 |
| 4,055,016 | 10/1977 | Katsenes | 42/73 |
| 4,122,623 | 10/1978 | Stice | 42/73 |
| 4,422,256 | 12/1983 | Maucher | 42/73 |

*Primary Examiner*—Charles T. Jordan
*Assistant Examiner*—Ted L. Parr

[57] ABSTRACT

A gunstock is provided with a cheekpiece which can be adjusted laterally and vertically relative to the gunstock. A pair of cams with eccentric pins are threadedly mounted on threaded studs on the gunstock, and each eccentric pin extends into a slot in the cheekpiece. When the cams are rotated on the studs, the eccentric pins move up or down and to the right or left to adjust the cheekpiece. The cheekpiece is held on the gunstock by a bolt which extends through the cheekpiece into a nut which is slidably mounted in a transverse slot in the gunstock.

4 Claims, 9 Drawing Figures

FIG. 2
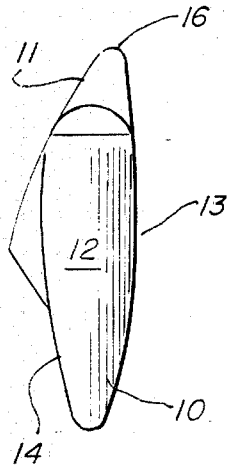
FIG. 1
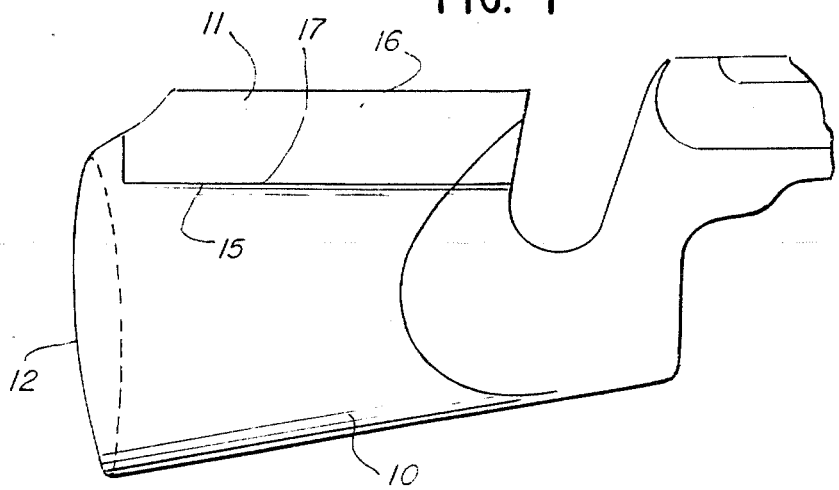
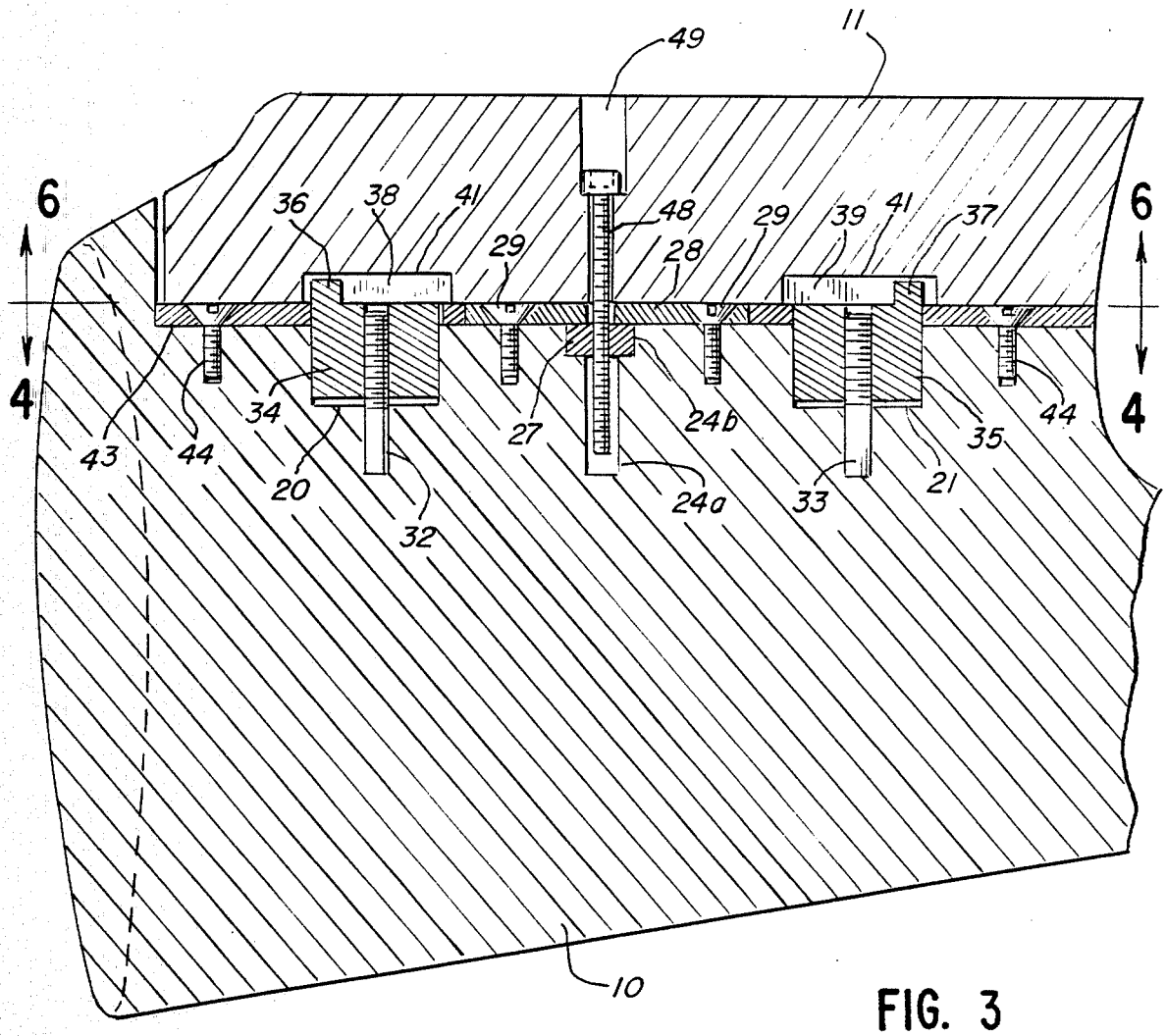
FIG. 3

ADJUSTABLE CHEEKPIECE FOR GUNSTOCK

BACKGROUND AND SUMMARY

This invention relates to an adjustable cheeckpiece for a gunstock, and, more particularly, to a cheekpiece which is adjustable vertically and laterally without spacers.

Gunstocks for rifles and other firearms are conventionally provided with a contoured cheekpiece or comb portion which fits against the shooter's face when the shooter sights down the barrel of the gun. Gunstocks with adjustable cheekpieces are available so that the cheekpiece can be adjusted to an individual shooter's preference. For example, U.S. Pat. Nos. 4,422,256, 4,122,623, and 3,710,496 describe adjustable cheekpieces.

U.S. Pat. No. 4,422,256 describes the use of spacers which are turned to various positions in order to adjust the cheekpiece. The embodiment illustrated in FIGS. 11–13 uses cylindrical spacers with eccentric pin portions on the ends for lateral adjustment. However, only limited vertical adjustment is provided by reversing the position of the spacers or by inserting the spacers in different holes.

The cheekpiece described in U.S. Pat. No. 4,122,623 can be adjusted only vertically and not laterally.

U.S. Pat. No. 3,710,496 describes a rather complex structure which uses two sets of vertical and horizontal screws to accomplish the adjustment.

The invention provides a simple yet reliable adjustment mechanism which provides for infinite adjustability in both the vertical and the lateral directions within the limits of adjustment. Both vertical and lateral adjustment is accommodated by the same adjusting members, which are cams mounted on threaded studs. When each cam is rotated, an eccentric pin on the cam moves both laterally and vertically to adjust the cheekpiece. The threaded engagement between the cam and the stud enables the lateral and vertical positions of the eccentric pin to be adjusted precisely.

DESCRIPTION OF THE DRAWING

The invention will be explained in conjunction with an illustrative embodiment shown in the accompanying drawing, in which—

FIG. 1 is a fragmentary side elevational view of a gunstock equipped with an adjustable cheekpiece in accordance with the invention;

FIG. 2 is an end view of the gunstock of FIG. 1;

FIG. 3 is a fragmentary sectional view of FIG. 1;

DESCRIPTION OF SPECIFIC EMBODIMENT

Figure 4:
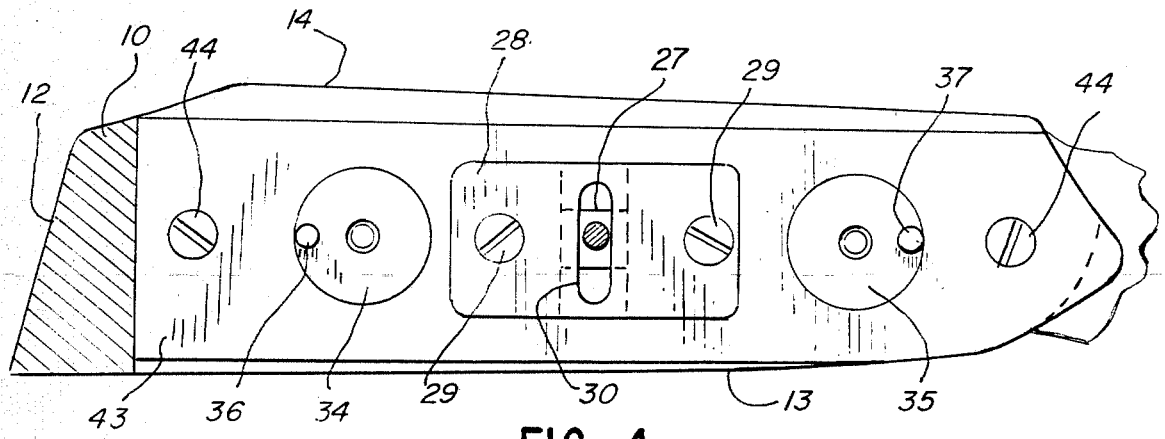
FIG. 4 is a fragmentary top plan view of the gunstock with the cheekpiece removed which would be seen along the line 4—4 of FIG. 3.

Referring first to FIGS. 1 and 2, a gunstock 10 is provided with an adjustable cheekpiece 11. The gunstock can be used with a conventional rifle or other firearm (not shown).

The gunstock 10 includes a butt end 12, elongated right and left side surfaces 13 and 14, and a flat upper surface 15. The cheekpiece 11 includes a curved top surface 16 and a flat bottom surface 17.

Figure 7:
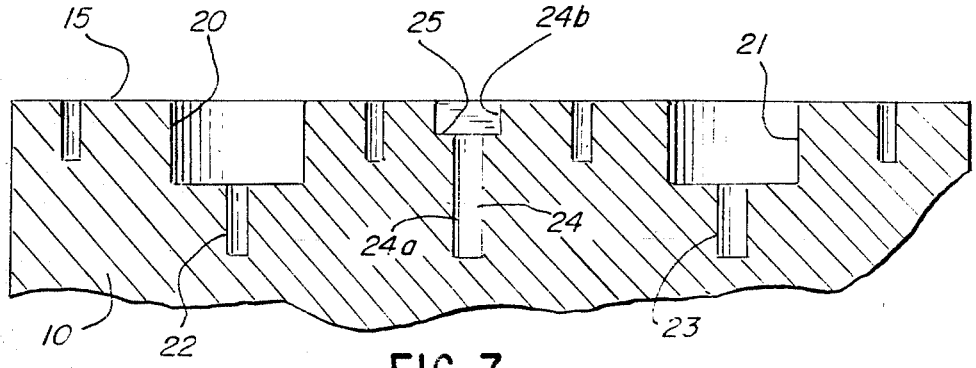
FIG. 7 is a fragmentary sectional view of the gunstock.
Figure 8:
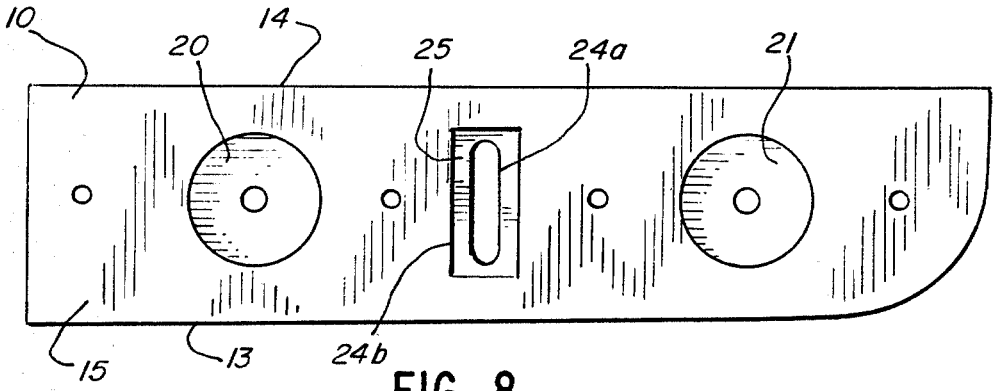
FIG. 8 is a top plan view of the gunstock of FIG. 7.

Referring now to FIGS. 7 and 8, the flat upper surface 15 of the gunstock is provided with a pair of cylindrical recesses 20 and 21 which are aligned in the longitudinal direction of the gunstock. A reduced-diameter bore 22 extends downwardly from the bottom of recess 20, and a bore 23 extends downwardly from the bottom of the recess 21. A slot 24 extends transversely between the right and left sides of the gunstock midway between the cylindrical recesses 20 and 21. The slot 24 is T-shaped in cross section and includes a relatively narrow bottom portion 24*a* and a wider top portion 24*b* which provides a flat shoulder which surrounds the bottom portion 24*a*.

A square nut 27 (FIG. 3) is slidably positioned within the top portion 24*b* of the slot 24 and is retained in the slot by a plate 28 (see also FIG. 4) which is attached to the upper surface of the gunstock by screws 29. The nut 27 is supported by the shoulder 25 of the slot 24, and the nut is prevented from rotating by the sides of the slot. The plate 28 is provided with a transverse slot 30 (FIG. 4) which has the same dimensions as the bottom portion 24*a* of the slot 24.

A stud 32 is inserted into the bore 22 within the cylindrical recess 20, and a stud 33 is inserted into the bore 23. Each stud has a knurled lower end which is non-rotatably anchored within the bore and a threaded upper end.

A generally cylindrical cam 34 is rotatably positioned within the cylindrical recess 20, and a cam 35 is rotatably positioned within the cylindrical recess 21. Each cam has a threaded central bore which is screwed onto the associated stud 32 or 33. An eccentric pin 36 extends upwardly from the cam 34, and an eccentric pin 37 extends upwardly from the cam 35.

Figure 6:
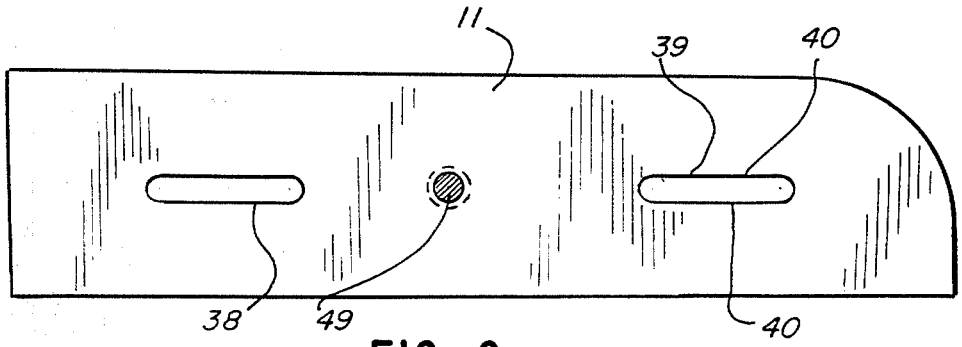
FIG. 6 is a bottom plan view of the cheekpiece which would be seen along the line 6—6 of FIG. 3.

The eccentric pins 36 and 37 extend into longitudinally extending slots 38 and 39 in the cheekpiece (see also FIG. 6) which are aligned along the longitudinal centerline of the cheekpiece. Each slot has a pair of side walls 40 (FIG. 6) and a flat top wall 41 (FIG. 3). The width of the slots is just slightly greater than the diameter of the eccentric pins.

Figure 9:
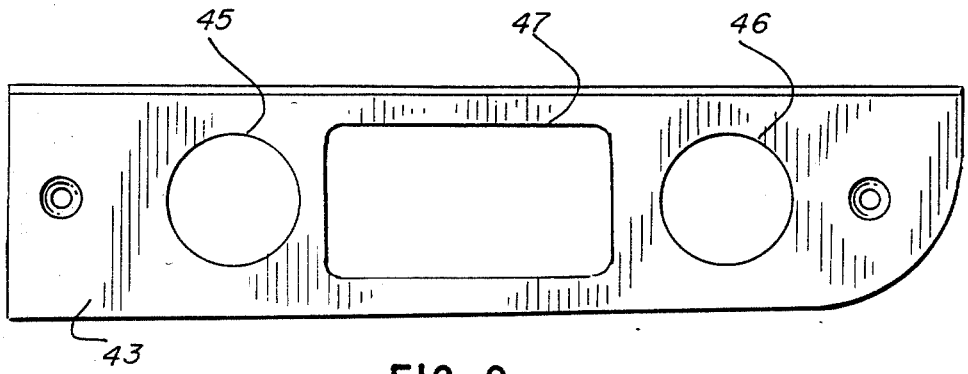
FIG. 9 is a plan view of the spacer plate.

A spacer plate 43 is attached to the top surface of the gunstock by screws 44. Referring to FIG. 9, the spacer plate has a pair of circular openings 45 and 46 for the cams 34 and 35 and a rectangular opening 47 for the bolt-retaining plate 28. The plates 43 and 28 have the same thickness.

The cheekpiece is attached to the gunstock by a long bolt 48 (FIG. 3) which extends through a countersunk bore 49 in the cheekpice and is screwed into the nut 27. Tightening the bolt draws the cheekpiece toward the gunstock, and when the cams 34 and 35 are at the bottoms of the recesses 20 and 21, the flat bottom surface of the cheekpiece will bear against the spacer plate 43.

Figure 5:
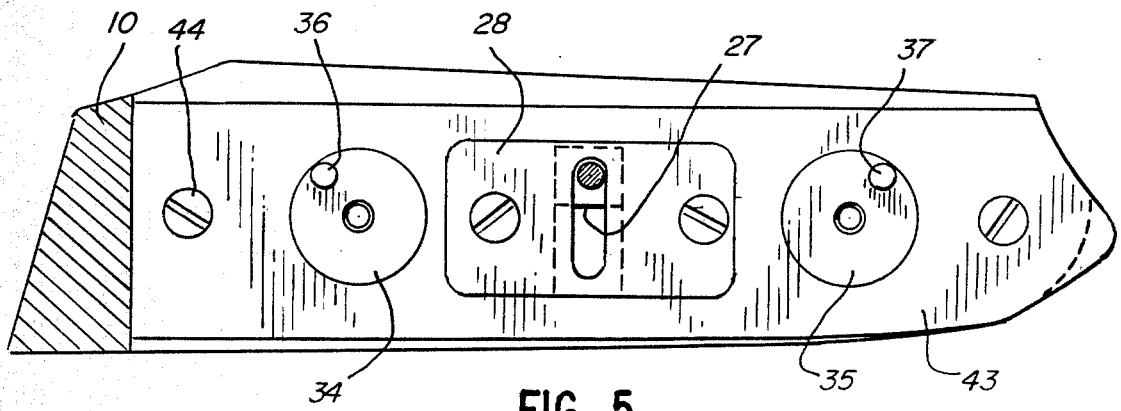
FIG. 5 is a view similar to FIG. 4 showing the eccentric pins in different positions.

If it is desired to adjust the position of the cheekpiece laterally, the bolt 48 is loosened, and the cheekpiece is moved laterally toward the right or left side of the gunstock. The lower end of the bolt 48 and the nut 27 move laterally in the transverse slot 24, and the lateral forces exerted on the eccentric pins 36 and 37 by the side walls of the slots 38 and 39 cause the cams 34 and 35 to rotate on the studs 32 and 33. FIG. 5 illustrates the positions of the cams and the nut 27 when the cheekpiece has been moved laterally toward the left side 14 of the gunstock. After the cheekpiece has been adjusted, the bolt is tightened to clamp the cheekpiece against the spacer plate 43.

Although the cams 34 and 35 move up and down on the studs 32 and 33 when the cams rotate during lateral adjustment, the vertical movement is insignificant because the cams rotate less than $\frac{1}{4}$ of a turn.

When it is desired to adjust the cheekpiece vertically, the bolt 48 is withdrawn from the cheekpiece, and the cheekpiece is removed from the gunstock. The cams 34 and 35 are then unscrewed from the studs 32 and 33 until the eccentric pins 36 and 37 have been raised the desired distance. The cheekpiece is then replaced, and the bolt is tightened to force the top walls 41 of the slots 38 and 39 against the eccentric pins. Lateral adjustment of the raised cheekpiece can be accomplished as previously described.

While in the foregoing specification a detailed description of a specific embodiment of the invention has been set forth for the purpose of illustration, it will be understood that many of the details hereingiven may be varied considerably by those skilled in the art without departing from the spirit and scope of the invention.

I claim:

1. In combination, a gunstock and an adjustable cheekpiece assembly, the gunstock having right and left sides, the cheekpiece assembly comprising:

a cheekpiece mounted on the gunstock, the cheekpiece having an elongated slot with a pair of side walls and a top wall, a threaded stud mounted in a recess in the gunstock, a cam positioned in said recess in the gunstock and threadedly engaged with the stud, the cam having an eccentric pin mounted eccentrically with respect to the stud, the eccentric pin extending into said slot in the cheekpiece in being engageable by the side walls of the slot whereby the lateral position of the cheekpiece can be adjusted by rotating the cam, the eccentric pin being engageable with the top wall of the slot when the cam is screwed upwardly on the stud whereby the cheekpiece can be adjusted vertically.

2. The structure of claim 1 in which the gunstock is provided with a slot which extends transversely between the right and left sides, a plate extending over the slot in the gunstock and being attached to the gunstock, the plate having a slot aligned with the slot in the gunstock, a nut slidably mounted in the slot in the gunstock below the plate, and a bolt extending through the cheekpiece and threadedly engaged with the nut for holding the cheekpiece on the gunstock.

3. A gunstock with an adjustable cheekpiece, the gunstock having elongated right and left sides and an elongated flat upper surface, the flat upper surface having a pair of longitudinally aligned cylindrical recesses and a transversely extending slot between the cylindrical recesses, a cam positioned in each of said cylindrical recesses and having an upwardly extending eccentric pin, a threaded stud threadedly engaged with each cam and extending into the gunstock, a plate attached to the flat upper surface of the gunstock above the transversely extending slot in the upper surface of the gunstock, the plate having a slot aligned with the transversely extending slot in the upper surface, a nut slidably mounted in the transversely extending slot in the gunstock below the plate, the cheekpiece being positioned above the flat upper surface of the gunstock and having an elongated flat lower surface, the flat lower surface of the cheekpiece having a pair of longitudinally extending slots above the cams, each of the slots in the cheekpiece having a pair of side walls and a top wall, the eccentric pin of each cam extending into one of the slots in the cheekpiece and being engageable with the side walls of the slot whereby the cheekpiece can be adjusted laterally by rotating the cams, the eccentric pin of each cam being engageable with the top wall of the associated slot when the cam is screwed upwardly on the stud whereby the cheekpiece can be adjusted vertically, and a bolt extending through the cheekpiece and threadedly engaged with the nut for holding the cheekpiece on the gunstock.

4. The structure of claim 3 including a spacer plate attached to the flat upper surface of the gunstock, the spacer plate being provided with a circular opening for each of the cams and a rectangular opening for said slotted plate, the spacer plate and the slotted plate having the same thickness.

* * * * *